US005975433A

United States Patent [19]

Hasegawa et al.

[11] Patent Number: 5,975,433

[45] Date of Patent: Nov. 2, 1999

[54] FUEL INJECTION NOZZLE WITH ROTARY VALVE

[75] Inventors: Toshiyuki Hasegawa; Takashi Kobayashi, both of Saitama-ken, Japan

[73] Assignee: ZEXEL Corporation, Tokyo, Japan

[21] Appl. No.: 08/959,050

[22] Filed: Oct. 28, 1997

[30] Foreign Application Priority Data

Nov. 8, 1996 [JP] Japan ..... 8-312862

[51] Int. Cl.[6] ..... F02M 61/18

[52] U.S. Cl. ..... 239/533.12; 239/533.4

[58] Field of Search ..... 239/95, 533.1–533.5, 239/533.9, 533.12

[56] References Cited

U.S. PATENT DOCUMENTS

| | | | |
|---|---|---|---|
| 4,339,080 | 7/1982 | Kopse | 239/533.3 |
| 4,658,824 | 4/1987 | Scheibe | 239/533.4 X |
| 4,984,738 | 1/1991 | Winquist | 239/95 X |
| 5,645,225 | 7/1997 | Hasegawa et al. | 239/533.12 |

FOREIGN PATENT DOCUMENTS

| | | |
|---|---|---|
| 59-200063 | 11/1984 | Japan . |
| 4-76266 | 3/1992 | Japan . |
| 7-54730 | 2/1995 | Japan . |
| 7-77124 | 3/1995 | Japan . |

*Primary Examiner*—Lesley D. Morris
*Attorney, Agent, or Firm*—Michael J. Striker

[57] ABSTRACT

A fuel injection nozzle with which it is possible to control the nozzle hole area and the injection period so that the injection pressure, the injection period and the injection amount are suited to the load and the speed of the engine and with which it is possible to conduct a pilot injection and a main injection certainly and precisely by simple control using a small actuator just by rotating this actuator in one direction. The fuel injection nozzle is of a type having a rotary valve disposed in a well, the rotary valve being rotated by an actuator to adjust the opening area of the nozzle holes formed in an enclosing wall bounding the well; the enclosing wall has a conical inner surface and the rotary valve has at its upper end a pressure-receiving surface for receiving the pressure of the pressurized fuel and has at its circumferential periphery a conical seat surface of an angle matching the angle of the conical inner surface of the enclosing wall. A plurality of pairs of fuel passages each pair consisting of a first passage and a second passage whose opening area is smaller than that of the first passage each passage having one end opening at the pressure-receiving surface and the other end connectable with the nozzle holes are provided in the rotary valve spaced in the direction of its rotation.

7 Claims, 8 Drawing Sheets

Fig. 5—A
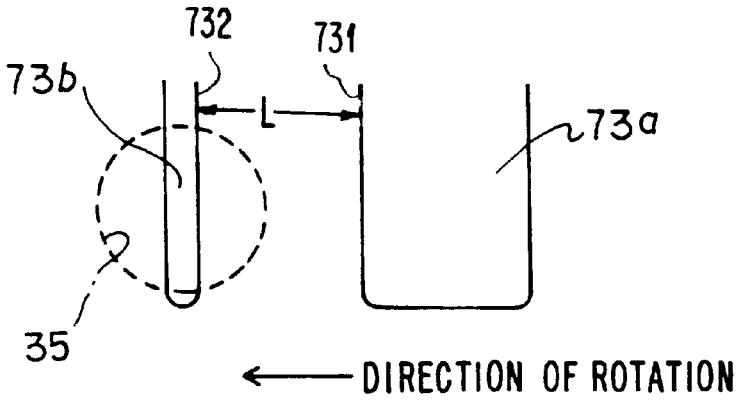
Fig. 5—B
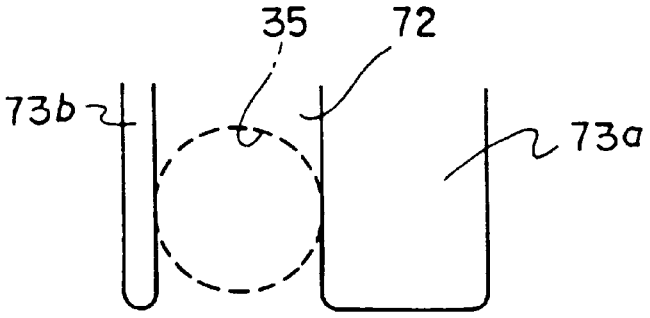
Fig. 5—C
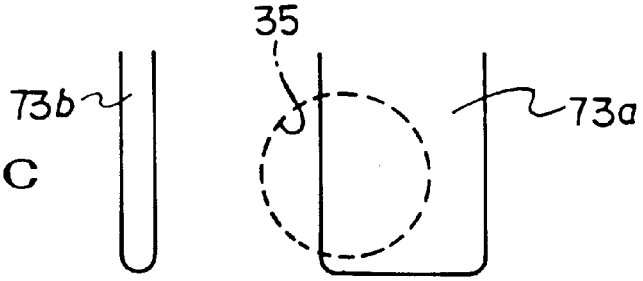

Fig. 7-A
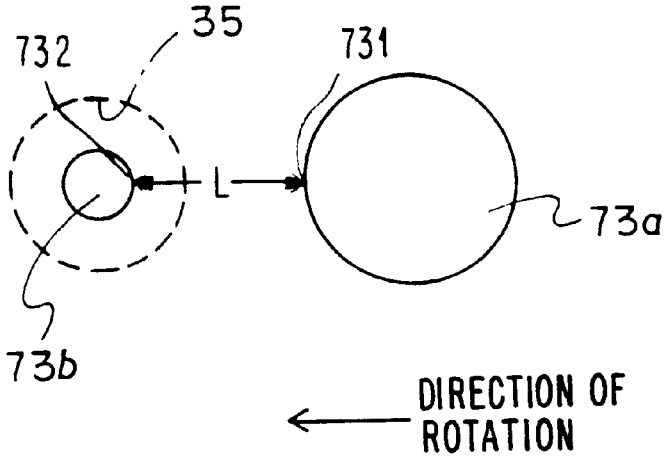
Fig. 7-B
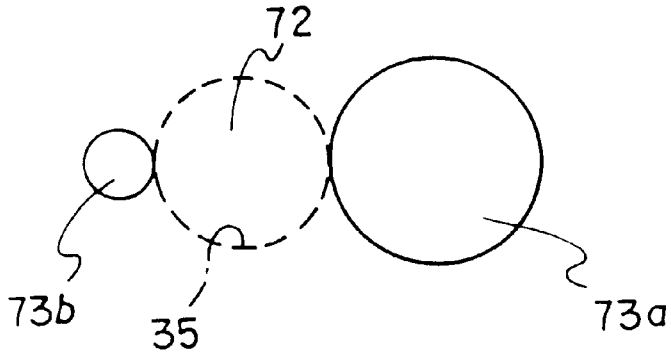
Fig. 7-C
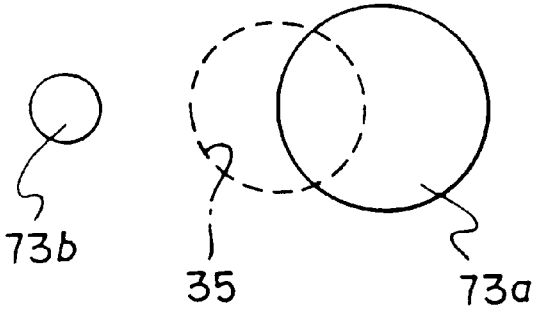

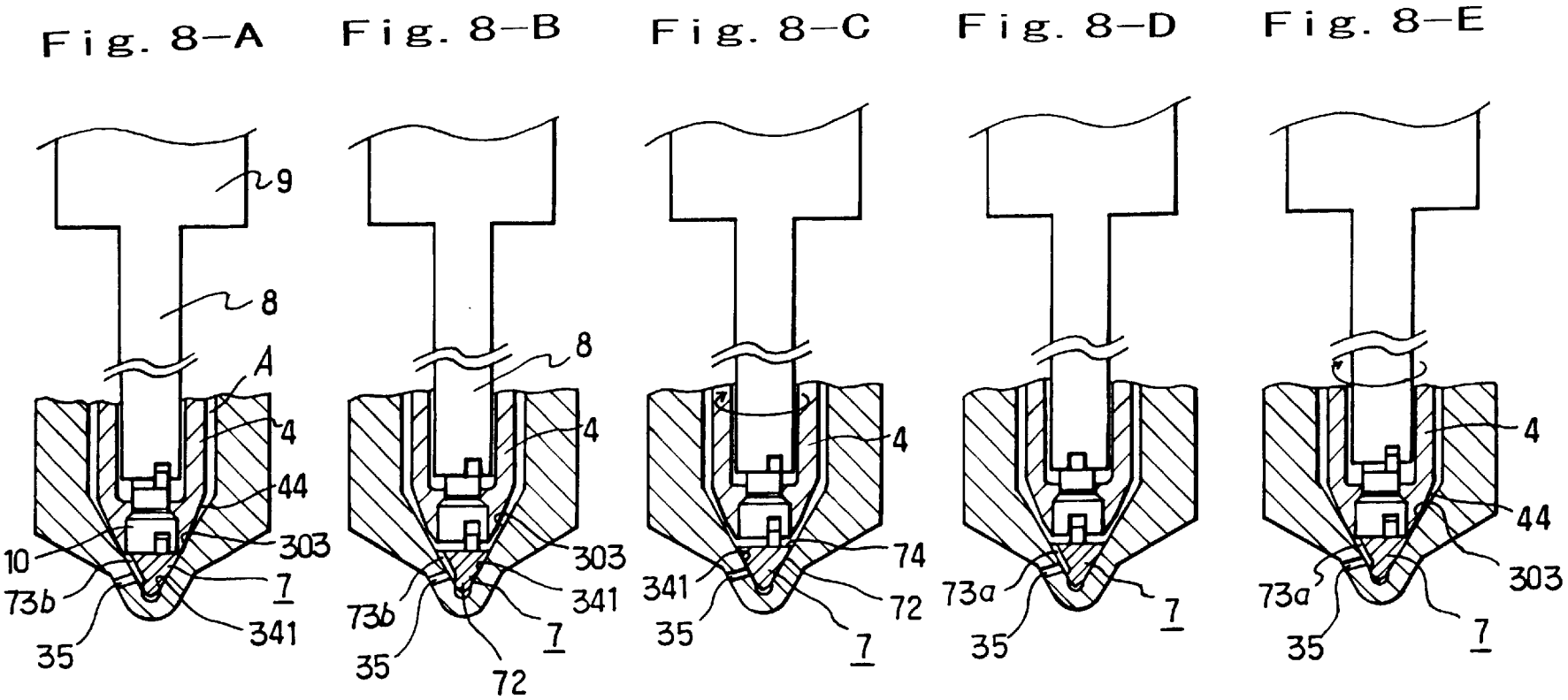
Fig. 8—A
9
8
A
4
44
303
7
341
10
73b
35
Fig. 8—B
8
4
303
341
7
72
73b
35
Fig. 8—C
4
74
72
7
341
35
Fig. 8—D
7
73a
35
Fig. 8—E
4
44
303
7
73a
35

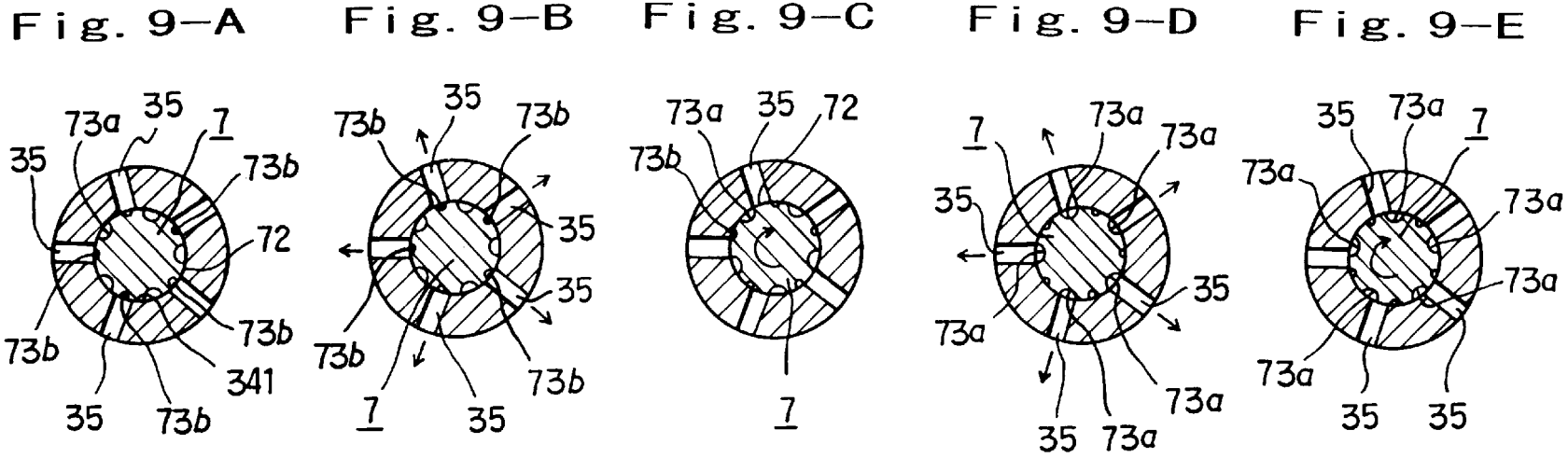
Fig. 9—A
Fig. 9—B
Fig. 9—C
Fig. 9—D
Fig. 9—E
7
35
73a
73b
72
341

FUEL INJECTION NOZZLE WITH ROTARY VALVE

FIELD OF THE INVENTION

This invention relates to a fuel injection nozzle, and particularly to a fuel injection nozzle whose nozzle hole area is variable.

BACKGROUND OF THE INVENTION

As means for supplying fuel in an atomized state to combustion chambers in an internal combustion engine such as a diesel engine, fuel injection nozzles are generally used. Such fuel injection nozzles, as disclosed for example in Japanese Unexamined Patent Publication No. S.59-200063, have had a construction wherein a conical pressure-receiving surface is formed at the tip end of a needle valve axially slidably received inside a nozzle body and the needle valve is opened by a fuel pressure being made to act on this pressure-receiving surface and fuel is injected into a combustion chamber of the engine through a plurality of nozzle holes formed in the tip of the nozzle body.

However, with this construction, the fuel injection pressure, the injected amount and the injection speed are generally determined by a fuel injection pump, and furthermore it is not possible to increase or decrease the total nozzle hole area. Consequently, during low-speed running of the engine the fuel injection pressure decreases and during low-load running of the engine the injection time becomes short and it is not possible to maintain a good combustion state, and it has been difficult to promote fuel combustion and achieve improvements in output and fuel consumption and reductions in combustion noise and NOx emissions.

As a measure to overcome this, in Japanese Unexamined Patent Publication No. H.4-76266, a variable nozzle hole fuel injection nozzle is proposed. In this related art, a well is formed in the tip part of a nozzle body and a plurality of nozzle holes (eight) connecting with the well are formed spaced in the circumferential direction in a wall enclosing the well. A rotating shaft passes through a through hole formed axially down the center of the needle valve, a tip portion of this rotating shaft is positioned in the well, and a plurality of channels (four) which connect a fuel pressure chamber inside the well to the nozzle holes when the needle valve opens are provided in the rotating shaft. By rotation of this rotating shaft, the number of open nozzle holes is switched between eight and four.

However, with this related art, because the rotating shaft itself is used as a rotary valve, there have been problems in that when there is a machining error the whole shaft becomes a defective product and that it is liable to stop rotating smoothly due to bending or twisting. Furthermore, the wall forming the well forms a straight cylinder parallel with the nozzle axis, and the rotating shaft serving as the rotary valve is also cylindrical. Consequently, it has been difficult to fix the position of the rotating shaft constituting the rotary valve during fuel injection. That is, even when the nozzle holes have been adjusted to a required degree of opening by the angle of the rotating shaft being changed the rotating shaft easily slips undesirably in its direction of rotation about its axis when a high fuel injection pressure acts at the nozzle holes. Consequently, it has not been possible to avoid the positional relationship between the nozzle holes and the channels slipping and the nozzle hole area becoming larger or smaller than the set size.

For this reason, in the related art there has been the problem that it has been difficult to accurately carry out control of the total nozzle hole area in accordance with the load and speed of the engine. In particular, to effect optimal fuel combustion of the engine it is preferable to control the injection rate, conducting a pilot injection before a main injection, but with the related art described above it has been practically impossible to realize an injection pattern of pilot injection—no injection—main injection.

Also, because as described above there is no mechanism for fixing the rotary shaft serving as a rotary valve during fuel injection, in the related art there has been the problem that a large and relatively high-torque motor is needed to drive the rotating shaft and consequently the fuel injection nozzle becomes large.

With regard to pilot injections, a control mechanism in a jerk-type fuel injection device is proposed in Japanese Unexamined Patent Publication No. H.7-77124. However, in this related art, because the fuel injection amount and the injection period and so on of the pilot injection are determined by the relative positions of a plunger and a leak hole of a fuel injection pump, there has been the problem that the degree of freedom of the various parameters is small. In Japanese Unexamined Patent Publication No. H.7-54730 a solenoid-driven fuel injection nozzle is proposed, but in this related art there has been the problem that it is not possible to apply an optimal nozzle hole area to a pilot injection.

SUMMARY OF THE INVENTION

The present invention was made as a result of research carried out to solve the kinds of problem described above, and it is a basic object thereof to provide a fuel injection nozzle with which it is possible to control the nozzle hole area and the injection period so that the injection pressure, the injection period and the injection amount are suited to the load and the speed of the engine and with which it is possible to conduct a pilot injection and a main injection certainly and accurately by means of simple control using a small actuator and driving this actuator in one direction.

To achieve this object and other objects, the invention provides a fuel injection nozzle of a type having a well for guiding pressurized fuel formed in the tip of a nozzle body and a needle valve opened and closed by a predetermined fuel pressure disposed on the entrance side of the well, a plurality of nozzle holes for spraying pressurized fuel provided spaced in the circumferential direction in an enclosing wall bounding the well, and a rotary valve disposed inside the well, the open nozzle hole area being adjusted by the rotary valve being rotated by an actuator, wherein the enclosing wall bounding the well has a conical surface and the nozzle holes open at this conical surface and the rotary valve has at its upper end a pressure-receiving surface for receiving the pressure of the pressurized fuel and has at its periphery a conical seat surface of an angle matching the angle of inclination of the conical surface of the well and when the fuel injection pressure acts on the pressure-receiving surface the conical surface and the conical seat surface are brought into frictional contact and the rotary valve is thereby held in position. A plurality of pairs of fuel passages consisting of a first passage and a second passage whose opening area is smaller than that of the first passage each having one end opening at the pressure-receiving surface and the other end connectable with the nozzle holes are provided in the rotary valve spaced in the direction of its rotation. As a result, as the rotary valve is rotated in one direction the nozzle holes are connected with the second passages, then covered by portions of the conical seat surface between the second passages and the first passages, and then connected with the first passages.

In a preferable form of the invention, the conical surface of the enclosing wall of the well and the conical surface of the rotary valve are given an angle such that a frictional holding torque overcoming a rotating torque tending to rotate the rotary valve in the circumferential direction arises as a result of injection pressure during fuel injection; the cross-section perpendicular to the axis of each of the first passages has a dimension no smaller than the diameter of the nozzle holes; and the spacing between the first passages and the second passages is no less than the diameter of the nozzle holes.

The first passages and the second passages may be made as channels in the conical seat surface of the rotary valve or may be holes formed so as to open at the conical seat surface and pass through the inside of the rotary valve.

Also, preferably, an angle detecting mechanism is provided on the output shaft of the actuator and this angle detecting mechanism is connected to a controller for driving the actuator and the angle of the rotary valve is corrected on the basis of a signal from the angle detecting mechanism.

In a fuel injection nozzle according to the invention, when the needle valve opens, a fuel pressure acts on the pressure-receiving surface and consequently the conical seat surface of the rotary valve and the conical surface of the well are brought into contact; a frictional force overcoming a rotating torque (a torque acting so as to rotate the rotary valve in its circumferential direction) arises between the conical seat surface and the conical surface, and as a result the rotary valve is held in position by the fuel injection pressure only.

Therefore, if the rotary valve is rotated until the second passages are severally connected with the nozzle holes in the well enclosing wall, the second passages, whose area in a cross-section area perpendicular to the axis thereof is relatively small, are used and a pilot injection is carried out. At this time, because the rotary valve and the well enclosing wall are tightly surface-sealed by the contact of their conical surfaces, pressurized fuel does not leak from the openings of the fuel passages in the circumferential direction and a correctly adjusted amount of fuel is injected.

From this state the rotary valve is rotated by the actuator being driven to apply a torque overcoming the above-mentioned frictional force to the rotary valve. As a result, the portions of the conical seat surface between the second passages and the first passages face the nozzle holes. When the driving of the actuator is stopped at this point, because the rotary valve is instantly held in position by the fuel pressure, the nozzle holes are certainly kept in a covered state and a no-injection state is created. At this time also, because the rotary valve and the inner wall of the well are being kept in contact with each other by the fuel injection pressure, fuel leakage in the circumferential direction is prevented.

If the actuator is driven again, because rotation of the rotary valve causes the first passages, whose opening area is relatively large, to start overlapping with the nozzle holes, the first passages are used and a main injection begins. Because at the start of this main injection the degree of opening of the nozzle holes changes gradually it is smooth, and if the torque supply to the rotary valve is stopped the rotary valve is certainly held in position instantly and a large quantity of fuel can be correctly injected.

Also, because the position of the rotary valve is fixed by the fuel injection pressure and a fuel passage arrangement made up of passages for pilot injections and passages for main injections having different opening areas is provided, a small, one-way rotation type actuator is sufficient and the fuel injection nozzle can be made compact.

When the fuel passages are made channels, because they can be formed just by machining the periphery of the rotary valve, the cost of the fuel injection nozzle can be lowered.

BRIEF DESCRIPTION OF THE DRAWINGS

FIGS. 5-A through 5-C are views illustrating a relationship between rotation of the rotary valve of FIG. 4 and change in nozzle hole area, FIG. 5-A showing a second passage connected with a nozzle hole (pilot injection state), FIG. 5-B showing a state wherein neither a second passage nor a first passage is connected with the nozzle hole (no-injection state) and FIG. 5-C showing a first passage connected with the nozzle hole (main injection state);

FIGS. 7-A through 7-C are views illustrating a relationship between rotation of the rotary valve of FIG. 6 and change in nozzle hole area, FIG. 7-A showing a second passage connected with a nozzle hole (pilot injection state), FIG. 7-B showing a state wherein neither a second passage nor a first passage is connected with the nozzle hole (no-injection state) and FIG. 7-C showing a first passage connected with the nozzle hole (main injection state);

FIGS. 8-A through 8-E are sectional views illustrating an example of the operation of a fuel injection nozzle according to the invention, FIG. 8-A showing a state preceding injection, FIG. 8-B showing a pilot injection state, FIG. 8-C showing a no-injection state following a pilot injection, FIG. 8-D showing a main injection state, and FIG. 8-E showing the state of the fuel injection nozzle at the end of injection;

FIGS. 9-A through 9-E are cross-sectional views at the level of nozzle holes illustrating an example of the operation of a fuel injection nozzle according to the invention, FIG. 9-A showing a state preceding injection, FIG. 9-B showing a pilot injection state, FIG. 9-C showing a no-injection state following a pilot injection, FIG. 9-D showing a main injection state, and FIG. 9-E showing the state of the fuel injection nozzle at the end of injection.

DETAILED DESCRIPTION OF THE PREFERRED EMBODIMENTS

A preferred embodiment of the invention will now be described with reference to the accompanying drawings.

Figure 1:
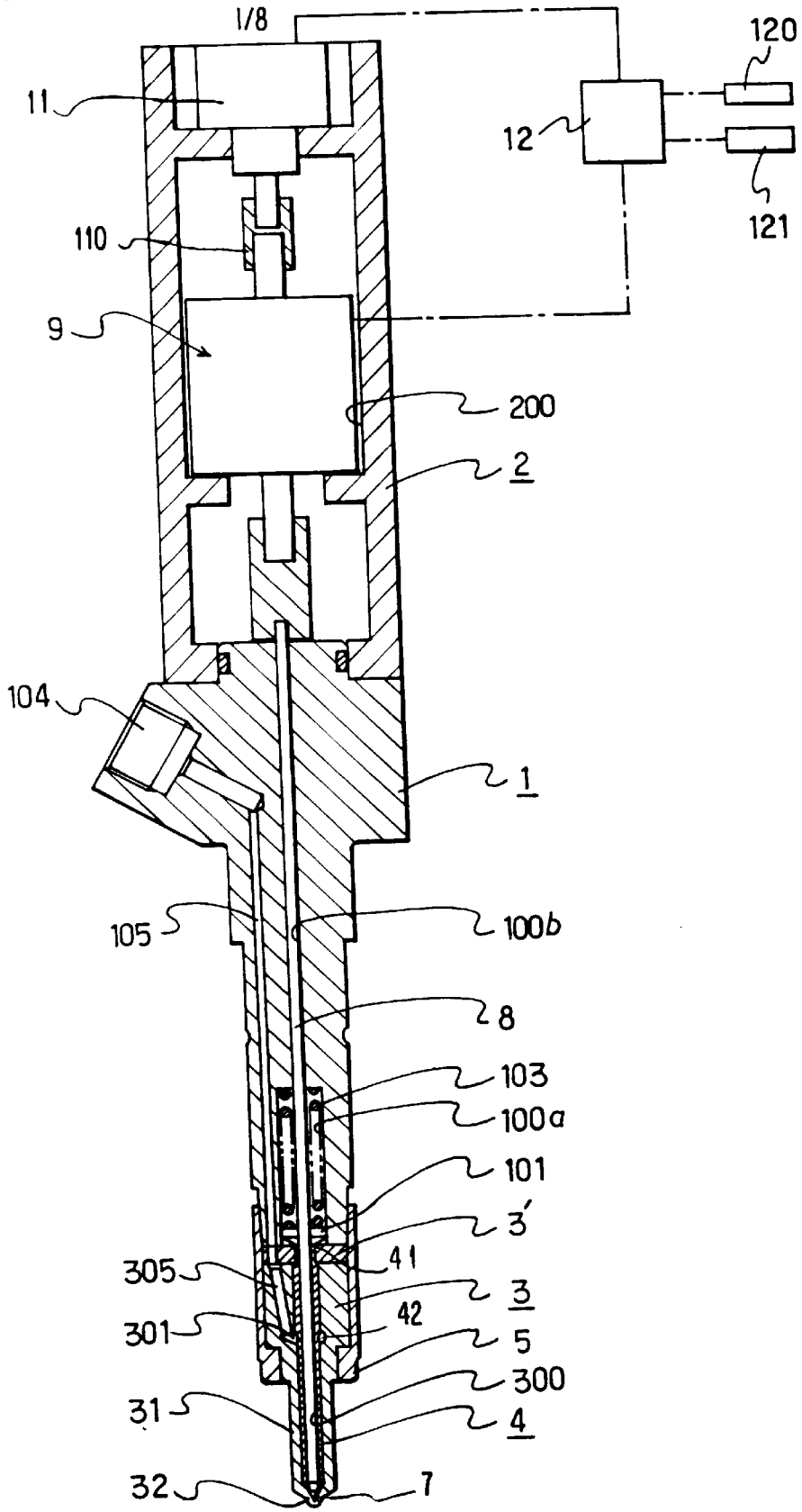
FIG. 1 is a longitudinal sectional side view of a preferred embodiment of a fuel injection nozzle according to the invention.

FIG. 1 through FIG. 5 show a preferred embodiment of a fuel injection nozzle according to the invention. In FIG. 1, the reference numeral 1 denotes a nozzle holder proper; 2 a driving head oiltightly fitted to the upper end of the nozzle holder proper 1; and 3 a nozzle body connected to the lower end of the nozzle holder proper 1 with a spacer 3 therebetween and fastened to the nozzle holder proper 1 by a retaining nut 5. The reference numeral 4 denotes a needle valve (nozzle needle) passing through the nozzle body 3.

A first hole 100*a* extending from the lower end of the nozzle holder proper 1 and a shaft hole 100*b* extending from the upper end of the first hole 100*a* to the upper end of the nozzle holder proper 1 are formed in the center of the nozzle holder proper 1. The first hole 100*a* is considerably larger in diameter than the shaft hole 100*b* and has a pushing member 101 slidably disposed inside it. A nozzle spring 103 for closing a needle valve 4, which will be further discussed later, is disposed between the top of the pushing member 101 and the upper end of the first hole 100*a*.

The nozzle body 3 has in its length-direction middle part a step which fits in the bottom of the inside of the retaining nut 5 and has tubular part 31 extending downward from this step through the retaining nut 5, and an enclosing wall 32 (tip part) for having nozzle holes formed therein is formed at the tip of the tubular part 31.

Figure 2:
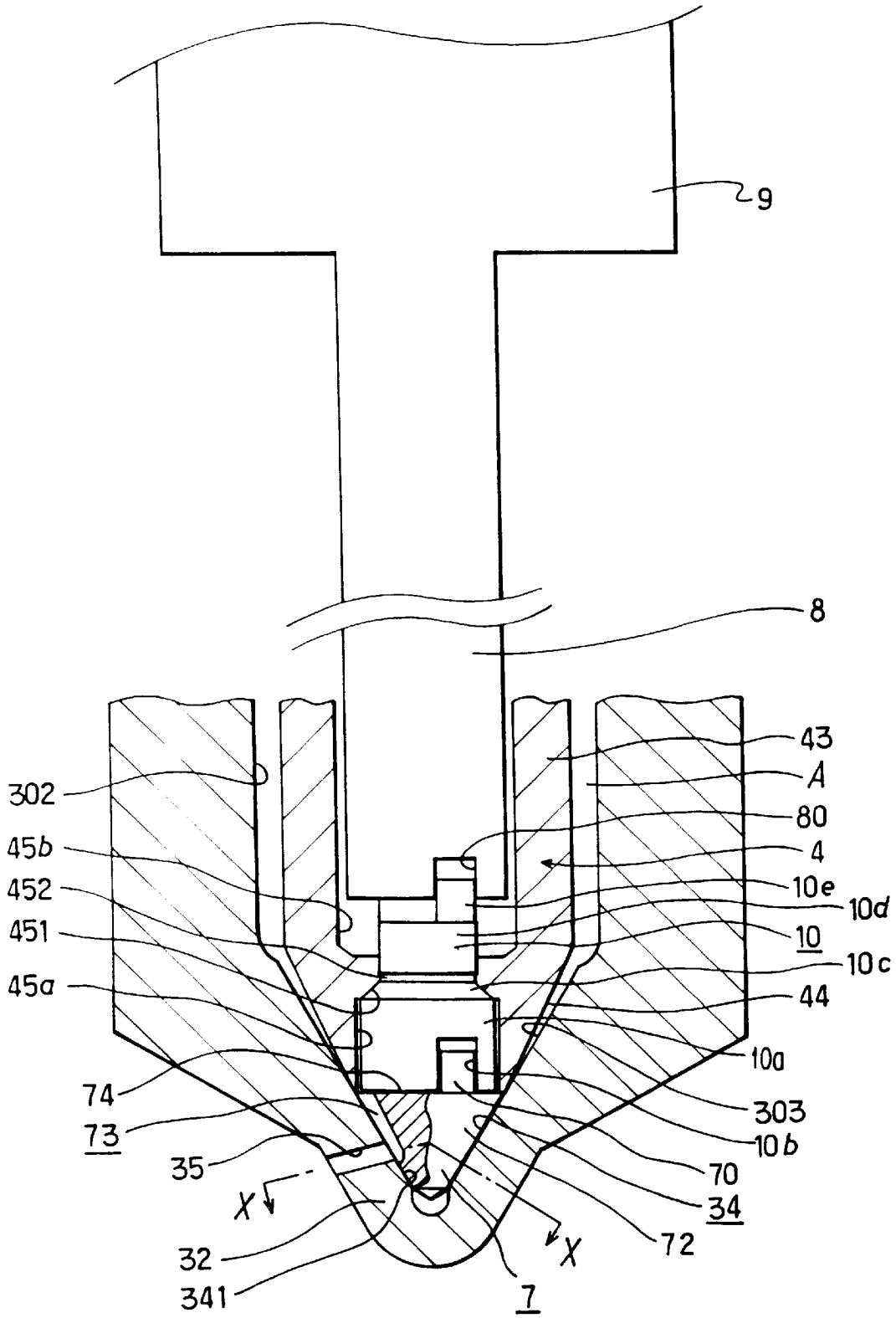
FIG. 2 is a partial enlarged view of FIG. 1.

In the center of the nozzle body 3, from the upper end to the lower end thereof, are formed a guide hole 300 concentric with the first hole 100*a* in the nozzle holder proper 1 and below that a fuel reservoir 301 of a larger diameter than the guide hole 300, and below the fuel reservoir 301 is formed a fuel feed hole 302, as shown in FIG. 2.

A conical seat surface 303 is formed at the lower end of this feed hole 302, as shown in FIG. 2, and continuing from this conical seat surface 303 a bottomed well 34 into which pressurized fuel is fed is formed by the enclosing wall 32.

A pressurized fuel supply opening 104 is provided on one side of the nozzle holder proper 1, as shown in FIG. 1, and this pressurized fuel supply opening 104 is connected to a jerk-type fuel injection device or an accumulator-type fuel injection device (not shown). The pressurized fuel supply opening 104 is connected with the fuel reservoir 301 by way of passage holes 105, 305 formed in the nozzle holder proper 1 and the nozzle body 3 and feeds pressurized fuel into the fuel reservoir 301.

The needle valve 4 has at its upper end a mating part 41 which mates with the pushing member 101, and has at its periphery a guide part which makes sliding contact with the guide hole 300 and a pressure-receiving part 42 for receiving the fuel pressure inside the fuel reservoir 301, and a shaft part 43 for forming an annular fuel passage A between itself and the feed hole 302 is provided below this pressure-receiving part 42, as shown in FIG. 2. A conical seat surface 44 for coming in and out of contact with the above-mentioned seat surface 303 is formed on the lower end of this shaft part 43.

The inner side of the enclosing wall bounding the well 34 has a conical surface 341 smoothly continuous with the seat surface 303, as shown in FIG. 2, and at the lower end of the conical surface 341 there is a hemispherical end wall surface. Thus the well 34 is a bottomed well.

Figure 3:
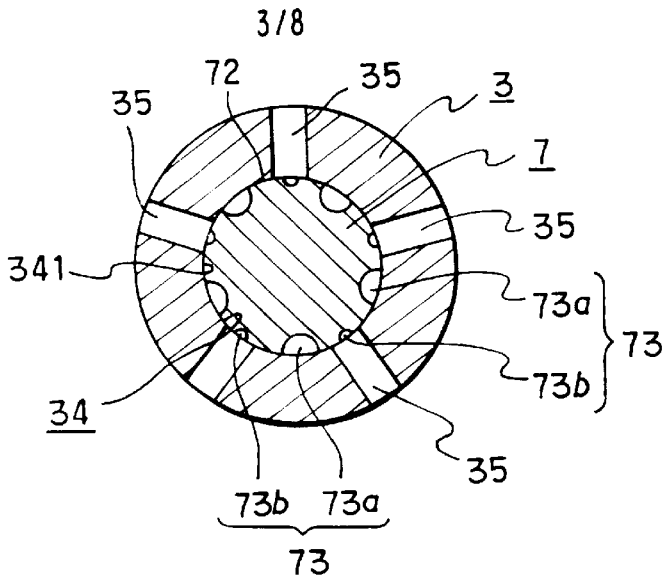
FIG. 3 is a sectional view on the line 3—3 in FIG. 2.

As shown in FIG. 3, a plurality of nozzle holes 35 connecting with the inside of the well 34 are formed with a uniform circumferential spacing in the enclosing wall 32 having the conical surface 341. In this preferred embodiment there are five nozzle holes 35 extending radially with a circumferential spacing of 72°. The axis of each nozzle hole 35 may be perpendicular to the nozzle axis, but in this preferred embodiment has a predetermined angle of inclination to the nozzle axis. Also, although the shape of each nozzle hole 35 in a cross-section perpendicular to its axis in this preferred embodiment is circular, it may alternatively be polygonal. When a polygonal cross-sectional shape is used, it is possible to make the amount of change in the nozzle hole area per unit angle of turn of a rotary valve discussed below large.

A rotary valve 7 is rotatably disposed in the well 34. To rotate the rotary valve 7, as shown in FIG. 1 a drive shaft 8 extends upward through the center of the needle valve 4 and this drive shaft 8 passes through the first hole 100*a* and the second hole 100*b* of the nozzle holder proper 1 and reaches the driving head 2 and is connected to the output shaft of an actuator 9 mounted in the driving head 2. Thus the rotary valve 7 can be rotated about the axis of the nozzle by the actuator 9 by way of the drive shaft 8.

As shown in FIG. 2, a first hole 45*a* is formed in the lower end of the needle valve 4, a conical surface 451 and a short hole 452 are formed at the upper end of this first hole 45*a*, and the short hole 452 connects with a second hole 45*b* of a larger diameter than the first hole 45*a*. The second hole 45*b* reaches the upper end of the needle valve 4. The drive shaft 8 is inserted into the second hole 45*b* and its lower end reaches the vicinity of the lower end of the second hole 45*b* and is coupled to the rotary valve 7 by way of a coupling 10 disposed there.

The coupling 10 is for transmitting turning torque and holding torque to the rotary valve 7 while allowing axial direction play of the rotary valve 7 caused by lifting of the needle valve 4, and an Oldham coupling or a similar type of coupling is used.

As shown in FIG. 2, the coupling 10 has a cylindrical portion 10*a* of a diameter such that it fits loosely in the first hole 45*a*, and a groove 10*b* for connecting to the rotary valve 7 slidably in the axial direction with respect thereto is formed in the lower end of this cylindrical portion 10*a*. A conical surface 10*c* which sits on the conical surface 451 is formed at the upper end of the cylindrical portion 10*a* of the coupling 10, a short shaft portion 10*d* fitting into the short hole 452 extends from the upper end of this conical surface 10*c*, a projecting piece 10*e* is formed on the upper end of this short shaft portion 10*d*, and this projecting piece 10*e* engages with a groove 80 provided in the lower end of the drive shaft 8 and transmits torque.

The actuator 9 is fixed in a space 200 provided in the driving head 2. The actuator 9 can be any actuator of a control type whose responsiveness is fast, and for example a stepping motor or a servo motor is used. The output shaft of the actuator 9 and the upper end of the drive shaft 8 are connected by means of a shaft coupling or are connected by a transmission element such as an eccentric pin or gears.

The rotary valve 7 is illustrated in FIG. 2 through FIG. 5-C. It has at its upper end a flat pressure-receiving surface 74 on which the pressure of pressurized fuel acts when the needle valve 4 is open. A projecting piece 70 is formed integrally in the approximate middle of this pressure-receiving surface 74, and this projecting piece 70 is fitted vertically slidably in the groove 10*b* of the coupling 10.

The rotary valve 7 has extending downward from the periphery of the pressure-receiving surface 74 a conical seat surface (conical surface) 72 tapering at an angle matching that of the conical surface 341 of the enclosing wall 32, and a frictional seat surface is formed by the conical surface 72 and the conical surface 341. The conical surface 72 is limited to a height such that its lower end does not make contact with the bottom wall of the well 34.

The radius r1 of the pressure-receiving surface 74 of the rotary valve 7, the lower end radius $r_2$ of the conical seat surface 72 and the inclination angle a of the conical seat surface 72 with respect to the nozzle axis are so selected that the rotating torque $T_1$ (Nm) tending to rotate the rotary valve 7 and the position-holding torque $T_2$ (Nm) provided by friction between the conical seat surface 72 and the conical surface 341 are in the relationship $T_1<T_2$. The inclination angle a of the conical surface 341 of the well 34 and the conical seat surface 72 of the rotary valve 7 is generally selected from the range of 50 to 70°, and therefore all that is necessary is to set $r_1$ and $r_2$ with this as a reference, and by doing this it is possible to fix the position of the rotary valve 7 with the fuel injection pressure alone.

Figure 4:
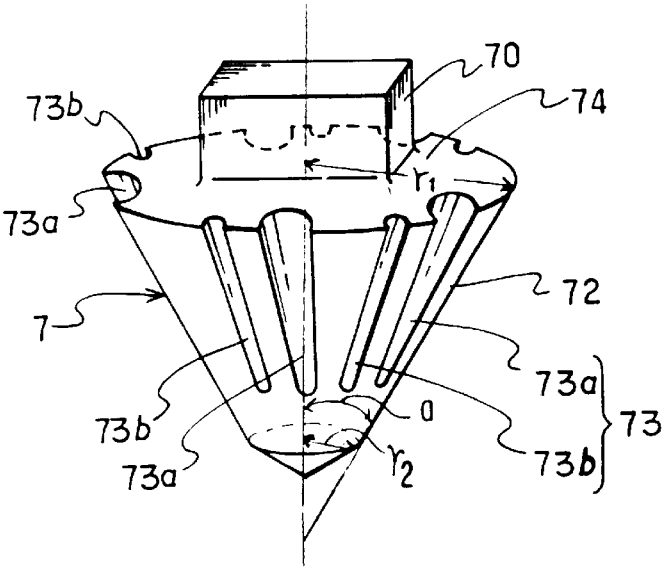
FIG. 4 is a perspective view showing an example of a rotary valve in the invention.

The rotary valve 7 has fuel passages 73 each having one end opening at the pressure-receiving surface 74 and the other end connectable with the nozzle holes 35 at the conical surface 341. As shown in FIG. 3 and FIG. 4, these fuel passages 73 are disposed in a plurality of pairs each made up of a first passage 73*a* and a second passage 73*b* and are arrayed in the order first passage 73*a*, second passage 73*b*, first passage 73*a* . . . .

The opening area of the second passage 73*b* is smaller than that of the first passage 73*a*. More particularly, as shown in FIG. 5-A, the cross-section of the first passage 73*a* perpendicular to the axis thereof has a dimension equal to or greater than the diameter of the nozzle holes 35, and the cross-section of the second passage 73*b* perpendicular to the axis thereof has a dimension smaller than the diameter of the nozzle holes 35. The spacing L between the first passage 73*a* and the second passage 73*b*, that is, the distance between the edge 731 of the first passage 73*a* and the edge 732 of the adjacent second passage 73*b*, is set at no less than the diameter of the nozzle holes 35.

In this preferred embodiment, the first passage 73*a* and the second passage 73*b* are slit-shaped channels, and the lower ends of the channels terminate at a position equivalent to approximately immediately below the nozzle holes 35. The channels in this preferred embodiment have their channel bottoms made substantially parallel with the angle of inclination of the conical seat surface 72. However, the channel bottoms may alternatively be parallel with the nozzle axis.

Figure 6:
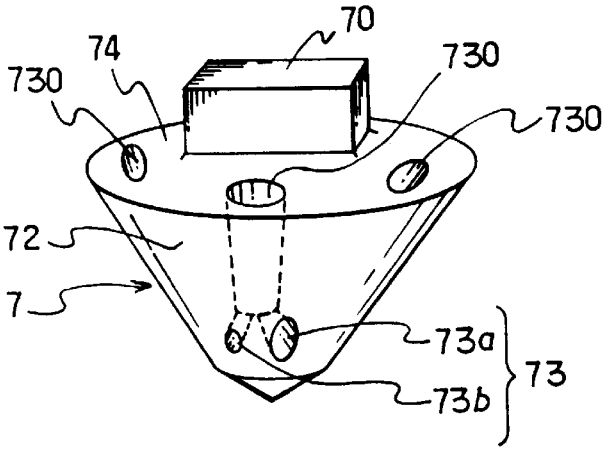
FIG. 6 is a perspective view showing another example of a rotary valve in the invention.

Another example of a rotary valve 7 that can be used in the invention is shown in FIG. 6 and FIGS. 7-A through 7-C. In this example, the first passage 73*a* and the second passage 73*b* are not channels but rather are holes having different diameters.

Although the first passage 73*a* and the second passage 73*b* may be completely separate holes, in this example, in consideration of ease of machining and the like, a common passage 730 is formed to a predetermined depth from the pressure-receiving surface 74 and a large hole and a small hole to serve as the first passage 73*a* and the second passage 73*b* respectively are formed so as to connect with this common passage 730. The rest of the structure is the same as that shown in FIG. 3 through FIG. 5-C and therefore corresponding parts have been given the same reference numerals and will not be described here.

The timing at which the rotary valve 7 is turned by the actuator 9 is preferably made a period when no axial direction force is acting on the drive shaft due to the internal pressure of the engine cylinder, i.e. during the intake stroke or the exhaust stroke of the cylinder. To carry out this rotation timing control, a controller 12 consisting of a CPU is electrically connected to the actuator 9 and an engine or fuel injection pump speed-detecting sensor 120 (or angle-detecting sensor) and a load-detecting sensor 121 are connected to inputs of the controller 12. By this means, a signal from the speed-detecting sensor 120 is constantly inputted into the controller 12, and when it is determined that the cylinder is in one of the above-mentioned strokes a driving signal is outputted to the actuator 9. A signal from the load-detecting sensor 121 is simultaneously inputted into the controller 12, and driving control of the actuator 9 is carried out according to a predetermined map of load and speed data.

Also, to carry out control of the rotation of the rotary valve 7, preferably, an angle detecting mechanism 11 is mounted on the rotary shaft arrangement. The angle detecting mechanism 11 is means for carrying out correction every fuel injection by detecting the actual angle of the drive shaft arrangement (and hence that of the rotary valve) and feeding this actual angle signal to the controller 12 as a feedback signal and causing a driving signal to be outputted from the controller 12 to the actuator 9 when there is an error between the actual angle of the rotary valve 7 and the set angle. The driving of the actuator 9 on the basis of the feedback signal from the angle detecting mechanism 11 is normally carried out when fuel injection is not being performed, but depending on the case it may also be carried out during fuel injection.

The angle detecting mechanism 11 may for example be a potentiometer, an encoder or a collimator. In this preferred embodiment a potentiometer is used: on the opposite side of the actuator 9 from the output shaft another output shaft is provided, and a potentiometer is connected to this by a shaft coupling 110.

Figure 10:
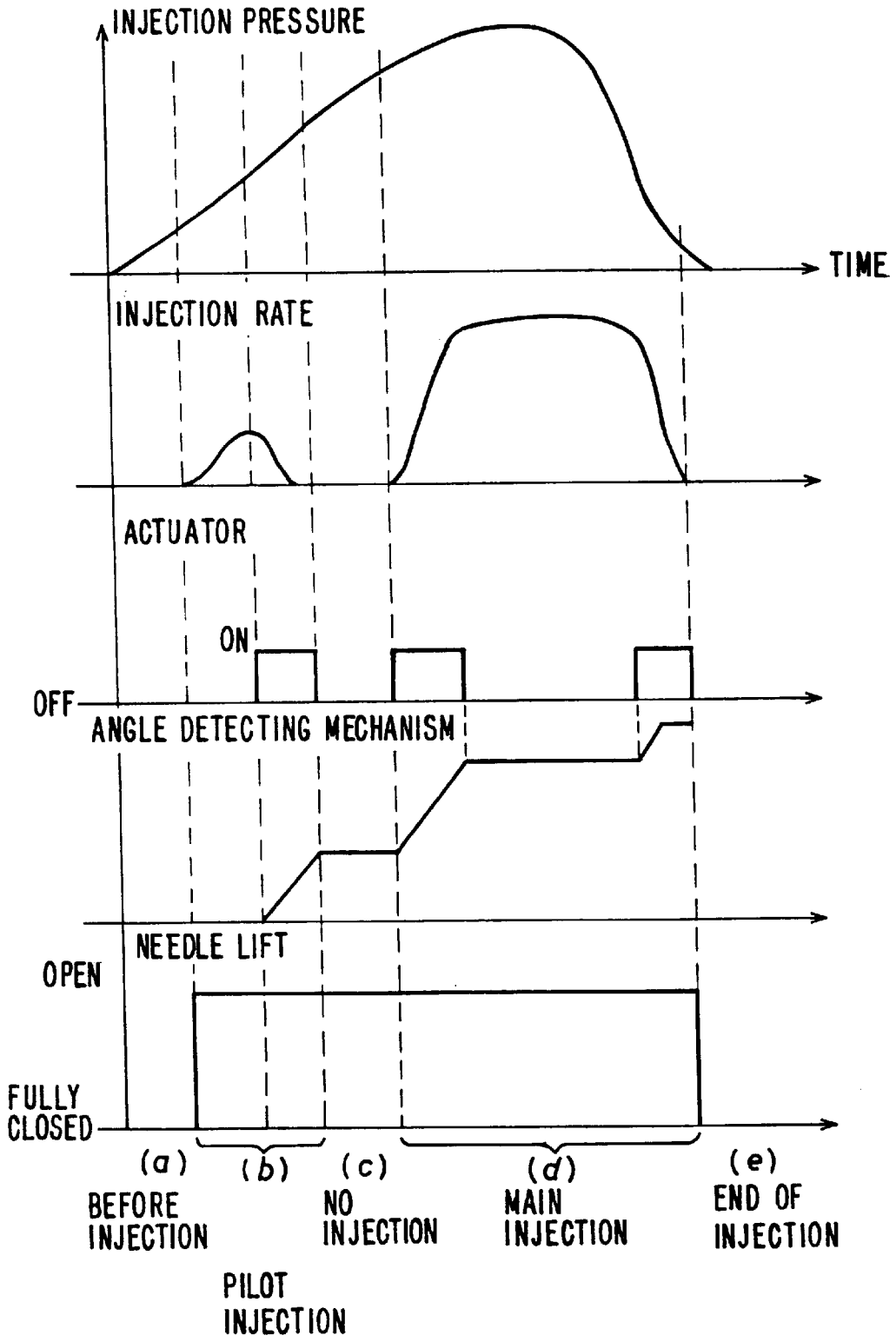
FIG. 10 is a chart showing an example of the operation of a fuel injection nozzle according to the invention.

FIG. 10 shows an example of an operation chart in the invention. The actuator is sequentially rotated in one direction at intervals, the angle detecting mechanism detects this rotation and injection of the pattern pilot injection—no injection—main injection is carried out. However, in the case of this invention, as described above, the conical seat surface 72 and the conical surface 341 of the well 34 are held in position by friction under the injection pressure of pressurized fuel acting on the pressure-receiving surface 74 of the rotary valve 7. Because of this, by making the difference between the holding torque $T_2$ on the rotary valve and the torque $T_1$ tending to rotate the rotary valve, i.e. $T_2-T_1$, small and applying a small torque just great enough to overcome this difference $\Delta T$ between $T_2$ and $T_1$ by means of the actuator 9, it is possible to rotate the rotary valve 7 and change the opening area of the nozzle holes 35 using the first passages 73*a* and the second passages 73*b* even when the needle valve is open and fuel is being injected. This is also included in the invention.

In this invention, the whole of the well enclosing wall does not necessarily have to have a conical surface. That is, a straight cylindrical surface parallel with the axis of the nozzle may be formed from the end of the seat surface 303 to the middle and the tapering conical surface 341 may be formed from the end of this straight cylindrical surface. In this case, the rotary valve 7 also has a straight cylindrical surface parallel with the nozzle axis from the pressure-receiving surface 74 to a middle part and the conical surface 72 is formed from the end of this. This is also included in the invention.

Also, although in this preferred embodiment there are five nozzle holes 35 and five pairs of fuel passages 73, of course the invention is not limited to this and there may alternatively be three or four or six or more of each.

Also, the drive shaft arrangement is not limited to that described in this preferred embodiment, and for example a coupling pin may be interposed between the drive shaft 8 and the coupling 10.

(Operation)

The operation of this preferred embodiment of the invention will now be described.

FIGS. 8-A through 8-E, FIGS. 9-A through 9-E and FIG. 10 show state changes from a state preceding an injection to the end of an injection, taking as an example a case wherein the rotary valve shown in FIG. 4 is used.

As is commonly known, pressurized fuel is fed from a fuel injection device (not shown) through a pipe to the pressurized fuel supply opening 104 and is pushed through the passage holes 105, 305 into the fuel reservoir 301 and from there passes down through the annular fuel passage A. This pressurized fuel simultaneously acts on the pressure-receiving surface 42 of the needle valve 4 located in the fuel reservoir 301, and when the fuel pressure reaches a pressure such that it overcomes the set force of the spring 103 the needle valve 4 is lifted and the seat surface 44 at the lower end of the needle valve moves away from the seat surface 303 of the nozzle body 3 and the needle valve 4 opens. If the fuel pressure falls, the needle valve 4 is pushed down and closed by the urging force of the nozzle spring 103.

Before an injection, as shown in FIG. 8-A, the needle valve 4 is closed, and when during an intake stroke or an exhaust stroke of the engine signals carrying information on the speed (or angle) and load of the engine or a fuel injection pump are sent to the controller 12 from the speed-detecting sensor 120 and the load-detecting sensor 121, a corresponding angle is calculated. A drive input signal corresponding to this is then fed to the actuator 9, a driving force from the actuator 9 is transmitted to the drive shaft 8, and by this rotating torque being transmitted through the coupling 10 to the rotary valve 7, the rotary valve 7 is rotated through a predetermined angle in for example the clockwise direction. When a set angle is reached, a drive-stopping signal is outputted to the actuator 9 and the rotary valve 7 is held in that position. At the time of the above-mentioned rotation, because no axial-direction load due to fuel pressure is acting on the rotary valve 7, the conical seat surface 72 is not in strong contact with the conical surface 341 of the well enclosing wall and therefore the rotary valve 7 can be rotated easily and smoothly through the desired angle.

As a result, the second passages 73*b* having small opening areas (sectional areas perpendicular to the axis) in the pairs of fuel passages 73 of the rotary valve 7 are severally aligned with the nozzle holes 35 to provide a nozzle hole area suited to pilot injection. The first passages 73*a* are not aligned with the nozzle holes 35 and are covered by the conical surface 341 of the well enclosing wall. This state is shown in FIG. 5-A and FIG. 9-A.

If from this state the fuel pressure rises and the needle valve 4 is opened, because high-pressure fuel enters the well 34 and acts on the lower end surface of the cylindrical portion of the coupling 10, the coupling 10 is lifted. Simultaneously with this, high-pressure fuel passes through the second passages 73*b* of the pairs of fuel passages 73 opening at the pressure-receiving surface 74 of the rotary valve 7 and is injected through the nozzle holes 35. Because the opening area of the second passages 73*b* is small, fuel is pilot-injected through the nozzle holes 35. This is the state shown in FIG. 5-A, FIG. 8-B and FIG. 9-B.

At the time of this pilot injection, the fuel injection pressure acts on the pressure-receiving surface 74 at the upper end of the rotary valve 7. As a result the rotary valve 7 is pushed down in its axial direction, the conical seat surface 72 at its periphery comes strongly into surface contact with the conical surface 341 of the well enclosing wall and forms a surface seal, and a frictional holding force arises there. This frictional holding force is greater than a force tending to rotate the rotary valve 7 exerted by injection pressure acting at the nozzle holes 35. As a result, the rotary valve 7, having been rotated to a predetermined angle for pilot injection while the needle valve 4 was closed, is firmly held in that position at the time of fuel injection. Also, the contact between the conical seat surface 72 and the conical surface 341 prevents leakage of high-pressure fuel in the circumferential direction.

Then, when an instruction ending the pilot injection is sent from the controller 12, the actuator 9 is driven again and the drive shaft 8 is driven from the above-mentioned angular position in the clockwise direction. The rotary valve 7 is thereby moved as shown by the arrow in FIG. 5-A, and the second passages 73*b* are moved out of alignment with the nozzle holes 35 and reach a position such that the nozzle hole area is zero, i.e. to a position such that the conical seat surface areas between the second passages 73*b* and the first passages 73*a* are aligned with the nozzle holes 35. This is the state shown in FIG. 5-B and FIG. 9-C.

When the rotary valve 7 has rotated as far as this position the driving of the actuator 9 is temporarily stopped. The instant this driving of the actuator 9 stops, the rotary valve 7 is held in position by the fuel pressure acting on the pressure-receiving surface 74 on the upper end of the rotary valve 7. Since the output of the angle detecting mechanism 11 is fed by way of the controller 12 to the actuator 9, the position of the rotary valve 7 is controlled with good accuracy.

In this state, because the nozzle holes 35 are covered by the conical seat surface 72 of the rotary valve 7, as shown in FIG. 8-C and FIG. 9-C, high-pressure fuel is not injected and the state is therefore one of no injection, and the injection rate is as shown in FIG. 10.

Next, when an instruction ordering a main injection is issued from the controller 12, the actuator 9 rotates in the clockwise direction again and the rotary valve 7 is thus rotated, and as a result the first passages 73*a*, whose opening area is relatively large, come to overlap with the nozzle holes 35, and when a nozzle hole area (the connected area of the first passages 73*a* and the nozzle holes 35) optimum for a main injection is reached so as to correspond with the load and the engine speed the driving of the actuator 9 is stopped and a main injection is started. This state is shown in FIG. 5-C, FIG. 8-D and FIG. 9-D. The degree of connection of the first passages 73*a* and the nozzle holes 35 gradually increases with rotation of the rotary valve 7.

When then after a predetermined time has elapsed an instruction ordering termination of the main injection is issued, the actuator 9 rotates in the clockwise direction again and the rotary valve 7 is rotated as shown in FIG. 9-E. As a result, the areas between first passages 73*a* and the second passages 73*b* of the pairs of fuel passages 73 reach positions facing the nozzle holes 35 and are stopped there. Simultaneously with the stopping of the rotary valve 7 the needle valve 4 descends and sits on the conical seat surface 303 and the injection ends completely.

This concludes one fuel injection cycle, and before the next injection is carried out the rotary valve 7 is rotated by driving of the actuator 9 and the second passages 73*b* are aligned with the nozzle holes 35 so that the nozzle hole area becomes one suited to pilot injection.

To obtain accuracy of the nozzle hole area determined by the position of the rotary valve 7, the driving of the actuator 9 is controlled with constant reference to the output of the angle detecting mechanism 11. By this means the position of the rotary valve 7 can be corrected, and variation in spray from injection to injection can be reduced.

FIG. 10 shows one example of operation of a fuel injection nozzle according to the invention, but the invention is not limited to this. That is, although in the chart of FIG. 10 the rotary valve 7 is stopped intermittently, depending on the speed of rotation of the actuator 9 an injection pattern of no injection—pilot injection—no injection—main injection can alternatively be obtained by rotating the actuator 9 continuously, without stopping it intermittently.

When the fuel passages 73 of the rotary valve 7 are made a type consisting of holes of different diameters of the kind shown in FIG. 6, during pilot injection the state is that shown in FIG. 7-A, during no-injection the state is that of FIG. 7-B, and during main injection the state is that of FIG. 7-C. Otherwise, this case is the same as that of the example described above.

In either case, in this invention, because the position of the rotary valve 7 is fixed by fuel injection pressure alone, a small and low-torque actuator 9 can be used and increase in the size of the fuel injection nozzle can thereby be avoided and positioning and installation of the fuel injection nozzle with respect to the engine can be made easy.

Also, because the rotary valve 7 and the well enclosing wall are surface-sealed together by their conical surfaces, so-called inter-nozzle hole fuel leakage wherein some fuel flows in the circumferential direction between the well enclosing wall and the peripheral surface of the rotary valve is prevented, and spraying with a correctly distributed spray amount is effected.

When the fuel passages 73 of the rotary valve 7 are made a channel structure, there is the merit that machining of the fuel passages 73 becomes easy and it is possible to achieve cost reductions. In this channel structure, when the channel bottoms are made parallel with the conical seat surface 72, because it is possible to make the area of the pressure-receiving surface 74 large, the holding torque on the rotary valve 7 can be made large.

Also, when the coupling 10 is provided with a conical surface 10*c*, because this and the conical surface 451 of the first hole 45*a* sit on each other, a resulting frictional force further increases the certainty of the holding of the rotary valve 7. Furthermore, surface sealing between the conical surfaces 10*c* and 451 also prevents leakage of fuel upward. As a result, spraying of fuel can be carried out with the injection pressure kept at the initial pressure.

What is claimed is:

1. A fuel injection nozzle having a well for guiding pressurized fuel formed in a tip part of a nozzle body and a needle valve opened by a predetermined fuel pressure disposed on the entrance side of the well and a plurality of nozzle holes for spraying pressurized fuel provided spaced in the circumferential direction in an enclosing wall bounding the well and a rotary valve disposed inside the well, the rotary valve being rotated by an actuator to adjust the opening area of the nozzle holes, wherein:

(i) the enclosing wall of the well has a conical inner surface and the nozzle holes open at this conical inner surface;

(ii) the rotary valve has at its upper end a pressure-receiving surface for receiving the pressure of the pressurized fuel and has at its circumferential periphery a conical seat surface of an angle matching the angle of the conical inner surface of the enclosing wall and when a fuel injection pressure acts on the pressure-receiving surface the conical inner surface and the conical seat surface come into frictional contact and the rotary valve is thereby held in position;

(iii) a plurality of pairs of fuel passages each pair consisting of a first passage and a second passage whose opening area is smaller than that of the first passage each passage having one end connecting with the pressure-receiving surface and the other end connectable with the nozzle holes are provided in the rotary valve spaced in the direction of rotation thereof; and (iv) by the rotary valve being rotated in one direction the nozzle holes are connected with the second passages and then covered by portions of the conical seat surface between the second passages and the first passages and then connected with the first passages.

2. A fuel injection nozzle according to claim 1, wherein the conical inner surface of the enclosing wall of the well and the conical seat surface of the rotary valve are given an angle such that a frictional holding torque overcoming a rotating torque tending to rotate the rotary valve in the circumferential direction arises as a result of injection pressure during fuel injection and the cross-section perpendicular to the axis of each of the first passages has a dimension no smaller than the diameter of the nozzle holes and the spacing between the first passages and the second passages is no less than the diameter of the nozzle holes.

3. A fuel injection nozzle according to claim 1 or 2, wherein the first passages and the second passages are slit-shaped channels of different sizes.

4. A fuel injection nozzle according to claim 1 or 2, wherein the first passages and the second passages are holes of different sizes.

5. A fuel injection nozzle according to claim 1, wherein the pressure-receiving surface of the rotary valve is coupled to a drive shaft by way of a coupling fitted in a tip portion of the needle valve and this drive shaft is driven by the actuator.

6. A fuel injection nozzle according to claim 5, wherein the pressure-receiving surface has a projecting piece and this projecting piece fits in a groove of the coupling axially slidably with respect thereto.

7. A fuel injection nozzle having a well for guiding pressurized fuel formed in a tip part of a nozzle body and a needle valve opened by a predetermined fuel pressure disposed on the entrance side of the well and a plurality of nozzle holes for spraying pressurized fuel provided spaced in the circumferential direction in an enclosing wall bounding the well and a rotary valve disposed inside the well, the rotary valve being rotated by an actuator to adjust the opening area of the nozzle holes, wherein:

(i) the enclosing wall of the well has a conical inner surface and the nozzle holes open at this conical inner surface;

(ii) the rotary valve has at its upper end a pressure-receiving surface for receiving the pressure of the pressurized fuel and has at its circumferential periphery a conical seat surface of an angle matching the angle of the conical inner surface of the enclosing wall and when a fuel injection pressure acts on the pressure-receiving surface the conical inner surface and the conical seat surface come into frictional contact and the rotary valve is thereby held in position;

(iii) a plurality of pairs of fuel passages each pair consisting of a first passage and a second passage whose opening area is smaller than that of the first passage each passage having one end connecting with the pressure-receiving surface and the other end connectable with the nozzle holes are provided in the rotary valve spaced in the direction of rotation thereof;

(iv) by the rotary valve being rotated in one direction the nozzle holes are connected with the second passages and then covered by portions of the conical seat surface between the second passages and the first passages and then connected with the first passages; and (v) an angle detecting mechanism is provided on the output shaft of the actuator and this angle detecting mechanism is connected to a controller for driving the actuator and the angle of the rotary valve is corrected on the basis of a signal from the angle detecting mechanism.

* * * * *